US010989407B1

(12) United States Patent
Bacon

(10) Patent No.: US 10,989,407 B1
(45) Date of Patent: Apr. 27, 2021

(54) FLARE GAS ASSEMBLY

(71) Applicant: David Bacon, Bastrop, TX (US)

(72) Inventor: David Bacon, Bastrop, TX (US)

( * ) Notice: Subject to any disclaimer, the term of this patent is extended or adjusted under 35 U.S.C. 154(b) by 102 days.

(21) Appl. No.: 16/108,534

(22) Filed: Aug. 22, 2018

Related U.S. Application Data

(63) Continuation-in-part of application No. 15/587,960, filed on May 5, 2017, now Pat. No. 10,584,873.

(60) Provisional application No. 62/403,301, filed on Oct. 3, 2016, provisional application No. 62/332,811, filed on May 6, 2016.

(51) Int. Cl.

| | |
|---|---|
| ***F23C 7/00*** | (2006.01) |
| ***F23G 7/08*** | (2006.01) |
| ***E21B 41/00*** | (2006.01) |
| ***F23G 5/50*** | (2006.01) |

(52) U.S. Cl.
CPC ..... *F23G 7/085* (2013.01); *E21B 41/0071* (2013.01); *F23G 5/50* (2013.01)

(58) Field of Classification Search
CPC ..... F23G 7/085
USPC ..... 431/5, 202
See application file for complete search history.

(56) References Cited

U.S. PATENT DOCUMENTS

| | | | | | |
|---|---|---|---|---|---|
| 3,995,986 | A * | 12/1976 | Straitz, III | F23G 7/085 | 431/114 |
| 4,392,817 | A * | 7/1983 | Berlie | F23G 7/085 | 422/182 |
| 4,643,669 | A * | 2/1987 | Bozai | F23G 7/085 | 431/114 |
| 4,652,232 | A * | 3/1987 | Schwartz | F23G 7/085 | 431/202 |
| 4,824,361 | A * | 4/1989 | McGill | F23G 7/085 | 431/114 |
| 5,810,575 | A * | 9/1998 | Schwartz | F23G 7/085 | 431/5 |
| 6,012,917 | A * | 1/2000 | Wiseman | F23C 5/02 | 431/154 |
| 2007/0224564 | A1* | 9/2007 | Hong | F23L 7/005 | 431/202 |
| 2010/0112502 | A1* | 5/2010 | Wunning | F23D 14/66 | 431/215 |

* cited by examiner

*Primary Examiner* — Avinash A Savani
(74) *Attorney, Agent, or Firm* — Bushman Werner, P.C.

(57) ABSTRACT

A flare gas assembly having an air pipe with an upper open end, a first conduit in surrounding relationship to the air pipe and having a first conduit upper end, a second conduit in surrounding relationship to the first conduit and having a second conduit upper end, and a third conduit in surrounding relationship to the second conduit and having a third conduit upper end, the upper ends of the air pipe, the first conduit and the second conduit being below the upper end of the third conduit, there being an air source connected to the air pipe to provide air to the air pipe at a desired flow rate.

20 Claims, 8 Drawing Sheets

FLARE GAS ASSEMBLY

CROSS REFERENCE TO RELATED APPLICATION

This application is a continuation-in-part of U.S. application Ser. No. 15/587,960, filed May 5, 2017, which in turn claims priority to U.S. Application No. 62/403,301 filed on Oct. 3, 2016, and U.S. Application No. 62/332,811, filed May 6, 2016 the disclosures of which are all incorporated herein by reference for all purposes.

FIELD OF THE INVENTION

The present invention relates to flares for burning waste gas and, more particularly, to a flare gas assembly for burning flare gases, particularly such gases produced at a gas processing facility at a well site (Gas Plant).

BACKGROUND OF THE INVENTION

At oil and gas well sites, particularly where drilling is conducted in shale formations, there is an array of equipment, as for example tank batteries to collect crude oil and/or distillates from the oil and gas wells, separators to separate gas/water from hydrocarbons and vapor recovery towers (VRT) to recover flashed gas from pressurized streams. Generally speaking, tank batteries are a source of low pressure flare gas while separators are a source of high pressure flare gas, e.g., 50 to 1500 psig. VRT gas is generally at a pressure of less than about 50 psig. In any event, the gases cannot be allowed to accumulate as the pressure build up could create hazards to humans as well as potential damage to equipment. Nor can they be vented to atmosphere for environmental reasons. To alleviate this problem, these gases, collectively Gas Plant Gases, are vented from the equipment and flared using a suitable flare gas assembly.

The low pressure gases from tank batteries, i.e., tanks that hold product (oil) for truck loading, present a particular challenge. Generally speaking, tank batteries are at atmospheric pressure and venting allows the product to easily flow in and out. However, the low pressure gas vented cannot be allowed to escape to the atmosphere lest environmental regulations be violated. From a practical perspective, the only way to prevent these low pressure hydrocarbon emissions from escaping to the atmosphere is by flaring.

A typical tank battery is equipped with relief valves, such as Kim ray valves well known to those skilled in the art, which relieve pressure from the tank when it exceeds about 4 to 5 ounces, although the relief valve can be set to vent at higher pressures, e.g., 10 ounces. The gas relieved from the pressure relief valve must, as discussed above, be flared. Flaring of low pressure tank battery gas can pose a problem not encountered in flaring of high pressure flare gas. High pressure gases generally have sufficient kinetic energy and do not require assist to burn smokelessly. However, because of its low pressure and insufficient kinetic energy, vented gas from tank batteries is normally flared using air assist flares. Typically, the air assist comes from a centrifugal or axial blower mounted at the bottom or side of the flare stack and a typical prior art flare handling low pressure tank battery emissions may have two 150 horsepower air blowers.

It is known that a properly operated low pressure air flare can achieve well over 98% destruction and removal efficiency (DRE) wherein DRE is the percent removal of hydrocarbon from the flare vent gas, provided that the air/hydrocarbon ratio is kept within a certain range. Thus, too much air can blow out the flame creating hydrocarbon emission detectible on Fourier Transfer Infrared (FTIR) cameras. In an attempt to overcome this problem, and maintain the air/hydrocarbon ratio in the desired range, prior art air flares handling low pressure flare gas, e.g., from tank batteries, typically employ blowers driven by electric motors with variable frequency (or variable speed) drives (VFD), These set ups also require additional, expensive equipment such as flow meters and process controllers, e.g., programmable logic controllers (PLCs) for efficient operation.

SUMMARY OF THE INVENTION

In one aspect, the present invention relates to a flare gas assembly for burning Gas Plant Gases.

In another aspect, the present invention relates to a flare gas assembly for flaring low pressure hydrocarbons wherein one or more blowers operated at constant speed(s) can provide virtually complete combustion of low pressure flare gas.

In still another aspect, the present invention relates to a flare gas assembly wherein the degree of combustion of entrained hydrocarbons in the flare gas(es) is substantially irrespective of the pressures/flow rates of the flare gas(es).

In still a further aspect, the present invention relates to a flare gas assembly wherein Gas Plant Gases can be virtually completely combusted using a combustion air blower system operated at a single, desired speed to provide a constant desired flow rate of combustion air.

In a further aspect, the present invention relates to a method of operating a flare gas assembly to flare Gas Plant Gases.

These and further features and advantages of the present invention will become apparent from the following detailed description, wherein reference is made to the figures in the accompanying drawings.

DETAILED DESCRIPTION OF PREFERRED EMBODIMENTS

Figure 1:
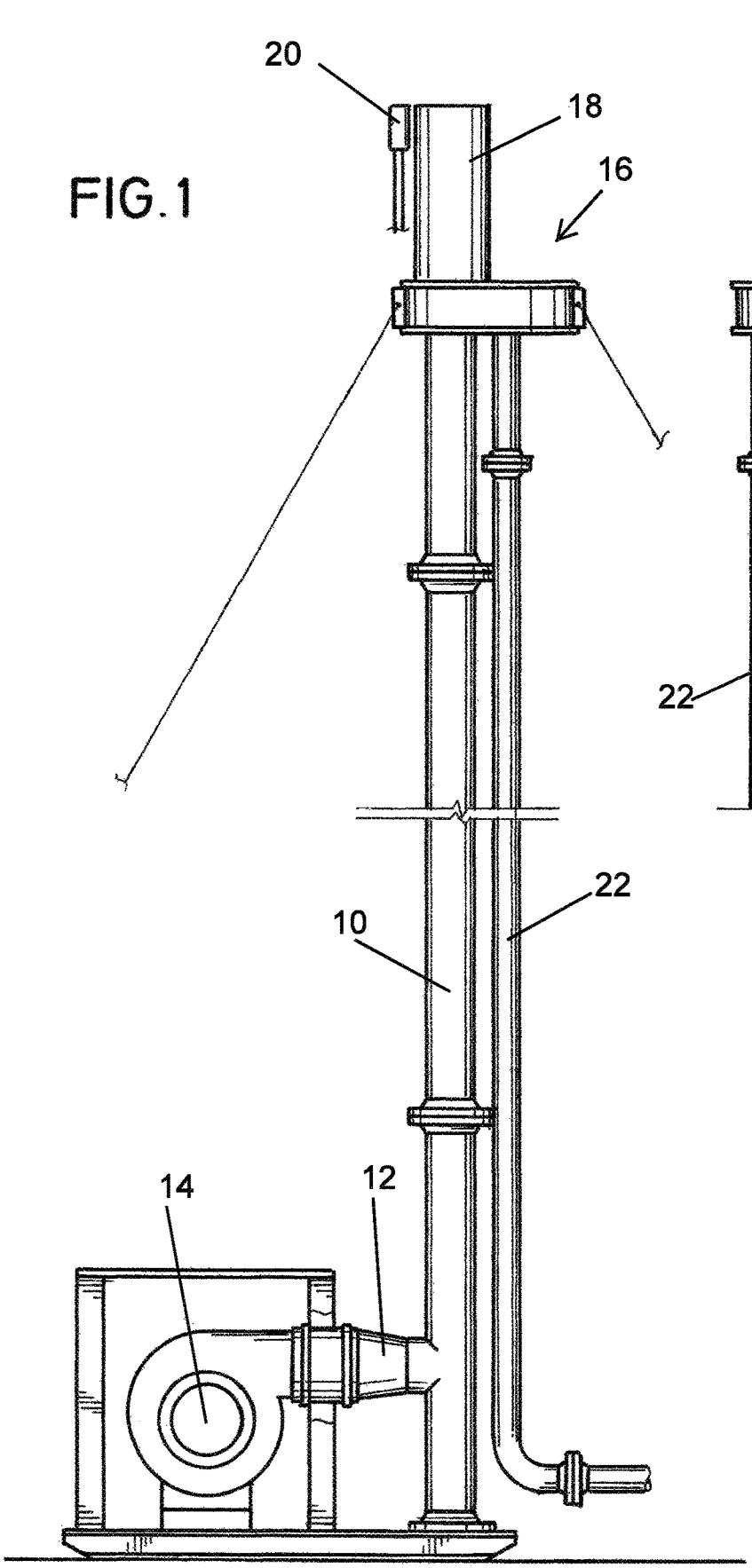
FIG. 1 is an elevational view of one embodiment of the flare gas assembly of the present invention.

Referring first to FIG. 1, there is an air stack or pipe 10 connected by piping 12 to a forced air blower 14. The air stack 10 which can be from about 20 to about 100 ft in length, is connected to a plenum assembly shown generally as 16 and described more fully hereafter. A flare pipe assembly 18 is connected to plenum assembly 16, flare pipe assembly 18 being adjacent a typical igniter 20.

Figure 2:
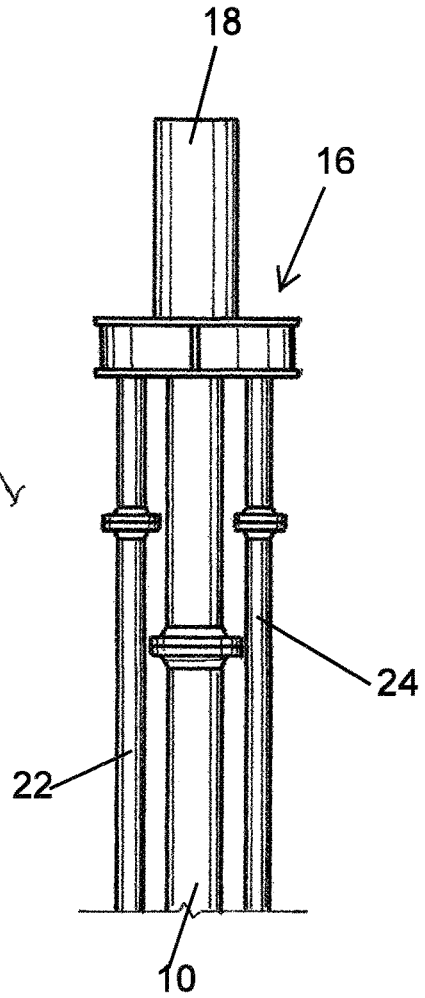
FIG. 2 is a partial elevational view of the flare gas assembly shown in FIG. 1 rotated 90° degrees.
Figure 4:
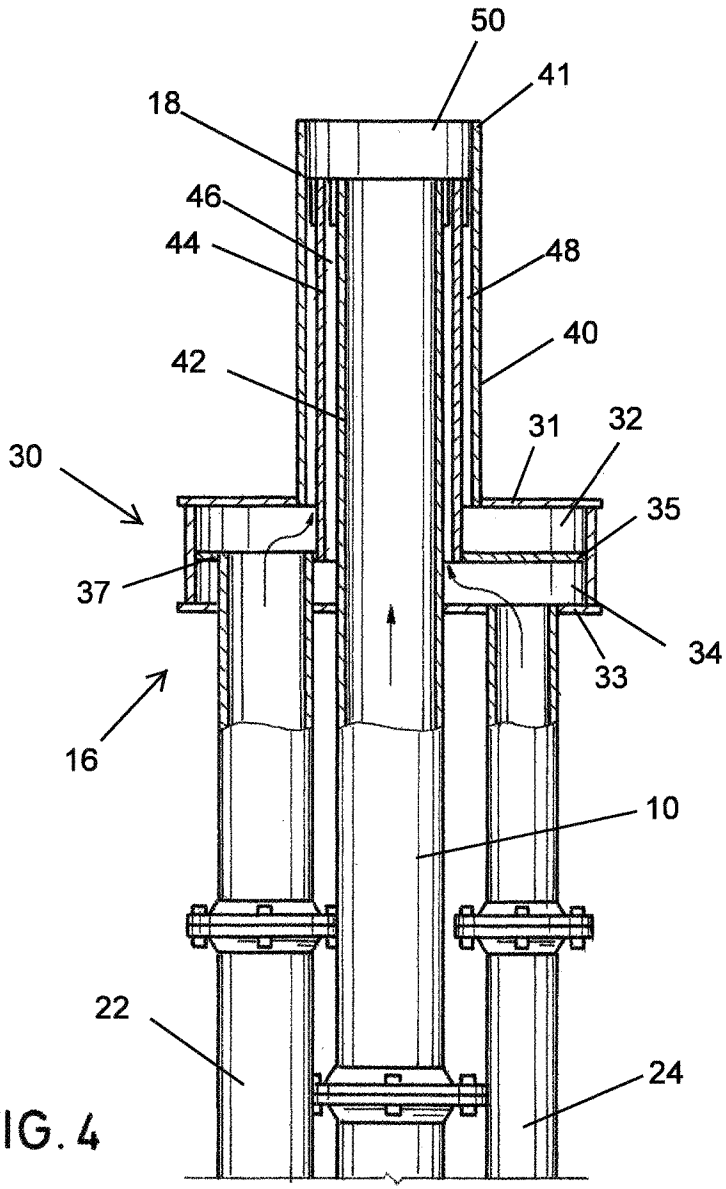
FIG. 4 is an elevational view, partly in section taken along the lines 4-4 of FIG. 3.

With reference to FIG. 2, a high pressure flare gas conduit 22 and a low pressure flare gas conduit 24 are connected to plenum assembly 16. Referring now to FIG. 4, it can be seen that plenum assembly 16 comprises a generally cylindrical housing shown generally as 30 in which is formed a high pressure flare gas plenum 32 and a low pressure flare gas plenum 34.

Figure 3:
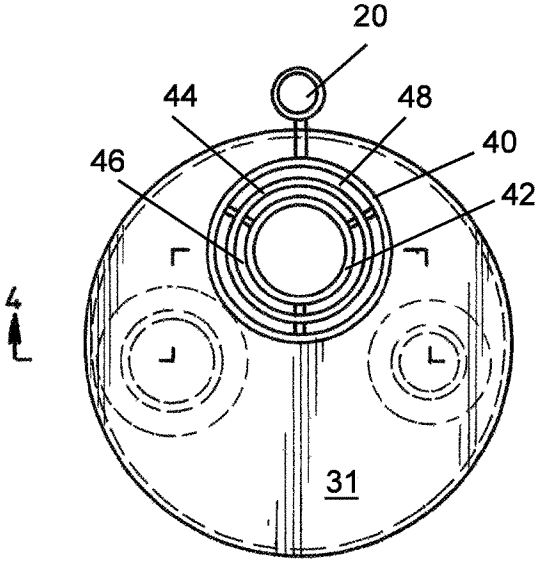
FIG. 3 is a top plan view of the flare gas assembly shown in FIG. 1.

Housing 30 as shown in FIG. 3, is generally circular when viewed in plan view. Housing 30 is comprised of a first or upper plate 31, a second or lower plate 33, and an intermediate plate 35, plates 31, 33, and 35 being connected to a peripheral wall 37 to form a generally cylindrical housing. As best seen in FIG. 4, first plenum 32 is formed by first plate 31, intermediate plate 35, and a part of peripheral wall 37, while second plenum 34 is formed by second plate 33, intermediate plate 35, and a part of peripheral wall 37. Again, as seen in FIG. 4, flare gas conduit 22 is connected to intermediate plate 35, and opens into plenum 32 while flare gas conduit 24 is connected to second plate 33 and opens into plenum 34.

While as described above, plenum housing 30 is generally cylindrical, it will be understood that it can take many shapes, e.g., rectangular, octagonal, etc.

As can be seen with reference to FIGS. 3 and 4, flare pipe assembly 18 comprises an outermost cylindrical pipe 40, an innermost cylindrical pipe 42 and an intermediate cylindrical pipe 44 which cooperate to form an inner annular flow path 46 and an outer annular flow path 48, As can be seen, the upper, terminal end 41 of outermost pipe 40 extends above the terminal ends of pipes 42 and 44 thereby forming a mixing chamber 50 above the upper terminal ends of pipes 42 and 44. Generally speaking in all the embodiments of the present invention, the distance between the upper terminal end 41 of the outermost pipe will be from about 2 to about 8 inches above the highest of the radially inner pipes, e.g., pipes 42 and 44. In a preferred case, the upper terminal end of pipes, e.g. 42 and 44 are coterminous.

In operation, air is forced upwardly through pipe 10 by means of blower 14 and exits into mixing chamber 50. High pressure gas from pipe 22 flows into plenum 32 and exits plenum 32 through outer annular flow path 48 into mixing chamber 50. Low pressure flare gas flows from pipe 24 into low pressure plenum 34 and exits through annular flow path 46 into mixing chamber 50. It can thus be seen that high pressure flare gas, low pressure flare gas, and air enter mixing chamber 50 and mix, the mixture being ignited by igniter 20.

While as shown in the embodiment of the invention depicted in FIGS. 1-4, the sources of high pressure and low pressure flare gases are introduced into the bottom of the plenum housing 30, it will be understood that the invention is not so limited. For example, gas conduit 22 could be connected to the peripheral wall 37 of plenum housing 30 such that the gas was introduced directly into plenum 32 and a like situation could avail with respect to gas conduit 24.

A feature of the flare gas assembly of the present invention is that the blower 14 can be operated at a single speed, e.g., a constant flow rate of from about 1,000 to about 10,000 CFM, and will effectively and efficiently combine with the flare gas(es) from annuli 46 and 48 in mixing chamber 50 resulting in an almost ideal smokeless flare. This occurs regardless of whether the high and low pressure flare gases are being vented individually or simultaneously, and is independent of their relative flow rates and pressures.

Figure 5:
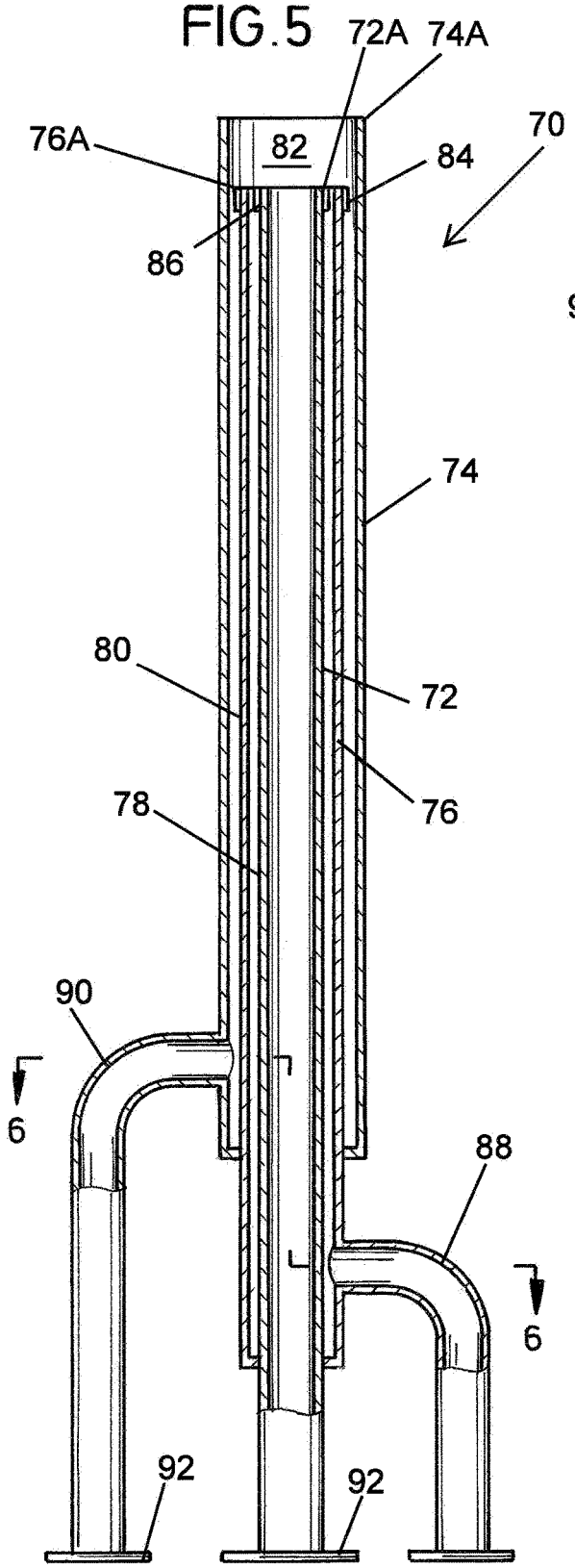
FIG. 5 is an elevation view, partly in section of another embodiment of the flare gas assembly of the present invention.
Figure 6:
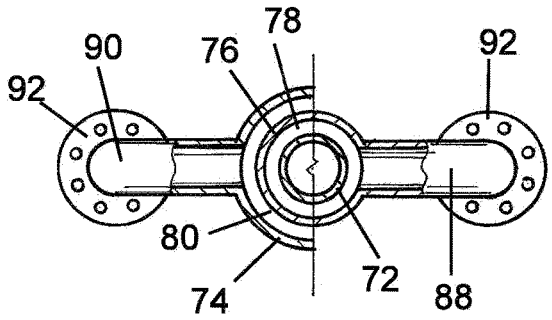
FIG. 6 is a view taken along the lines 6-6 of FIG. 5.

Referring now to FIGS. 5 and 6, there is shown another embodiment of the present invention. The flare stack assembly in FIG. 5 shown generally as 70 comprises an inner air stack or pipe 72, an outermost pipe, stack or conduit 74, and an intermediate pipe or stack 76. A first annulus 78 is formed between pipes 72 and 76 while a second annulus 80 is formed between outer pipe 74 and intermediate pipe 76. Pipe 74 has an upper end 74A while radially inward pipes 72 and 76 have upper ends 72A and 76A respectively. As seen, the upper end 74A of outer pipe 74 is above the upper ends 72A and 76A thereby forming a mixing chamber 82 above the upper ends 72A and 76A but below upper end 74A. As noted above, while the upper ends 72A and 76A are shown as being coterminous, such is not necessary, the only provision being that upper end 74A is above both upper ends 72A and 76A.

To maintain concentricity of concentric pipes at their upper ends, a series of radial tabs 84 extend between pipes 74 and 76 generally at 120° spacing while a similar set of tabs 86 extend between pipes 72 and 76, again being spaced at approximately 120°.

Forced air is fed to inner or air pipe 72 via a blower as described above with respect to the embodiment of FIG. 1. A pipe 88 connected to pipe 76 provides a flow path for a source of low pressure gas while a second pipe 90 connected to outer pipe 74 provides a conduit for a source of high pressure flare gas. As is typical, pipes 88 and 90 are flanged with flanges 92 for connection as needed.

Figure 7:
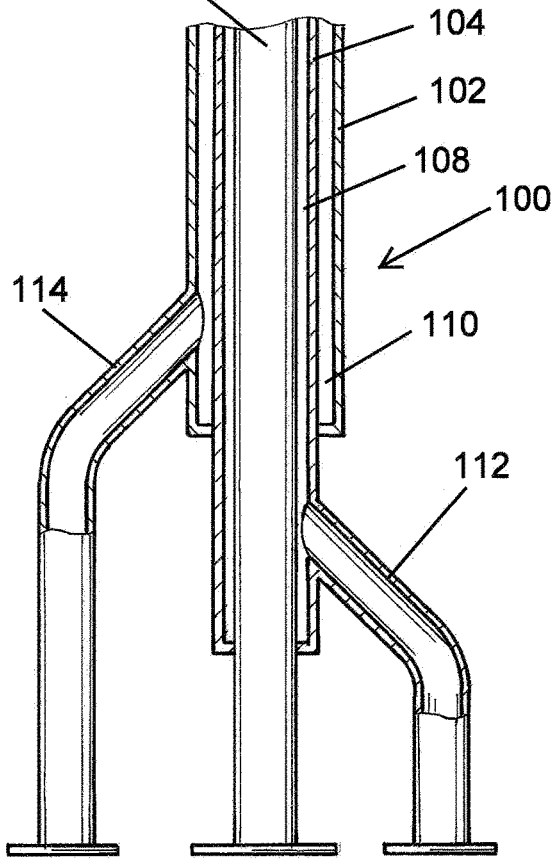
FIG. 7 is an elevational view of another embodiment of the present invention.

Referring now to FIG. 7 there is shown another embodiment of the present invention. The flare stack assembly of FIG. 7, shown generally as 100, comprises three generally concentric pipes or stacks 102, 104, and 106, pipe 104 being intermediate between pipes 102 and 106. As in the case of the other embodiments, air flows through pipes 106 while low pressure gas flows through the annulus 108 between innermost pipe 106 and radially intermediate pipe 104, and high pressure flare gas flows through the annulus 110 between the outermost pipe 102 and intermediate pipe 104.

The embodiment of FIG. 7 differs from that in FIGS. 5 and 6 in the fact that, whereas in the embodiment of FIG. 5, low and high pressure flare gases are introduced via piping 88 and 90, respectively, into annuli 78 and 80, respectively, generally at right angles, in the embodiment of FIG. 7, low pressure gas enters annulus 108 through angled pipe 112, while high pressure flare gas enters annulus 110 through angled pipe 114. In other words, in the embodiment of FIG. 7, the gas flows have both a radial and vertical vector component. Generally speaking, the angled portions of pipes 112 and 114 will be at an angle of from about 30° to 60° relative to a long axis passing concentrically through pipes 102, 104, and 106.

Figure 8:
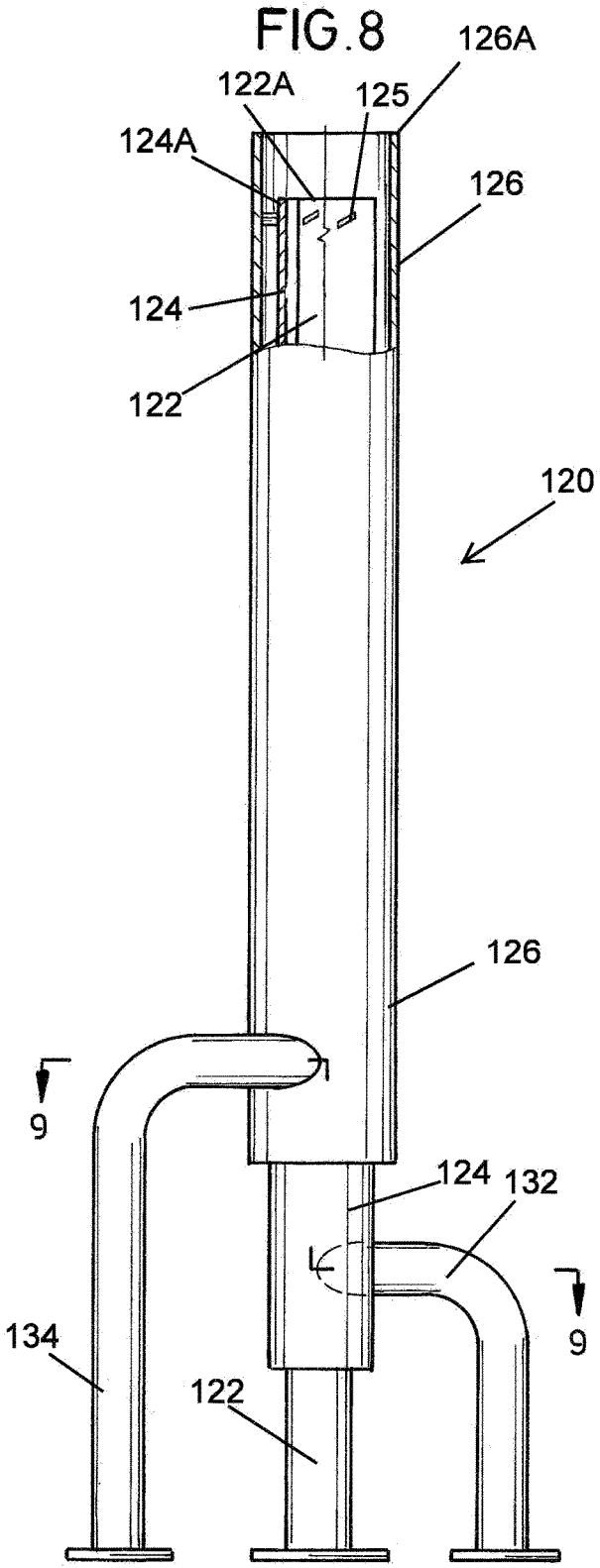
FIG. 8 is an elevational view of still a further embodiment of the present invention.
Figure 9:
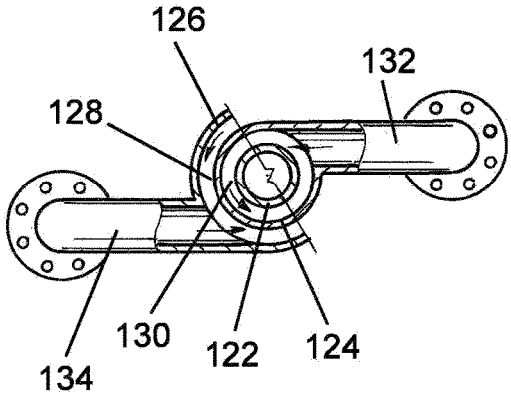
FIG. 9 is cross-sectional view taken along the lines 9-9 of FIG. 8.

Referring now to FIGS. 8 and 9, there is shown another embodiment of the present invention. The flare stack assembly of FIG. 8, shown generally as 120 again comprises three concentric generally vertically extending pipes comprised of innermost pipe 122, intermediate pipe 124, and radially outermost pipe 126. The pipes have respective upper ends 122A, 124A, and 126A, the upper ends 124A and 122A being below the upper end 126A. As best seen in FIG. 9, a high pressure annulus 128 is formed between outer pipe 126 and intermediate pipe 124, and a low pressure gas annulus 130 is formed between innermost air pipe 122 and radially intermediate pipe 124.

Low pressure flare gas is introduced into annulus 130 via feed pipe 132 which is offset from the centerline of annulus 130, e.g., generally tangential to pipe 124. Accordingly, low pressure gas entering annulus 130 is introduced in a swirling pattern as indicated by the arrows in FIG. 9, in like fashion, high pressure gas is introduced tangentially into annulus 128 via pipe 134.

Figure 10:
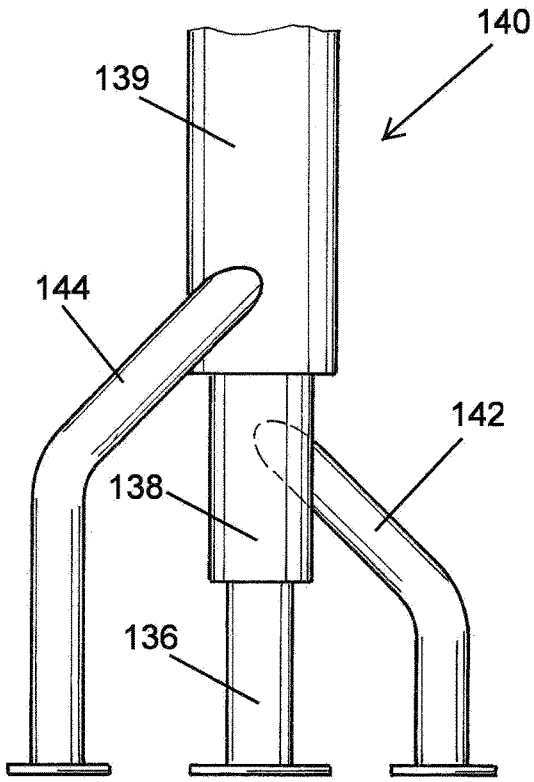
FIG. 10 is an elevational view of a further embodiment of the present invention.

Turning now to FIG. 10 there is shown yet another embodiment of the present invention. The flare gas assembly of FIG. 10, shown generally as 140, as in all the previous embodiments described above, comprises three preferably concentric pipes having relative elevation and disposition to one another at their upper ends as described above with respect to earlier embodiments, i.e., the upper end of the radially outermost pipe is above the upper ends of the radially inner pipes. The embodiment of FIG. 10 differs in that low pressure flare gas is introduced into the low pressure flare gas annulus by a pipe 142 which is connected both at an angle and tangentially to pipe 138 while high pressure gas is introduced into the high pressure flare gas annulus by pipe 144 which is connected both at an angle and tangentially to pipe 139. Basically, in the embodiment shown in FIG. 10, the high pressure and low pressure gases are introduced into the respective plenums via a combination of the piping arrangements shown in FIGS. 7, 8, and 9. This arrangement imparts both an upward and swirling motion to the gases as they are introduced into the respective plenums. Further, spacer tabs 125 between the respective pipes can be angled, as shown, to impart spin to air/gases exiting from the air pipe and the annuli between the pipes. If desired, the tabs could be shaped as spiral vanes to generate a helical motion in the exiting air/gas. In all other respects, the embodiment of FIG. 10 is as described above with respect to the other embodiments.

The piping arrangement used in the embodiments in FIGS. 8 and 9 to introduce the high and low pressure flare gases to the system can also be employed with respect to the embodiments shown in FIGS. 1-4. Thus, rather than having high pressure gas flow from pipe 22 into plenum 32, while low pressure flare gas flows into plenum 34 from pipe 24 in directions shown in FIGS. 1-4, pipes 22 and 24 could be connected to the sides and/or bottom walls of plenums 32 and 34, respectively, in a manner such that gas flow into the plenums has a tangential/helical pattern.

Figure 12:
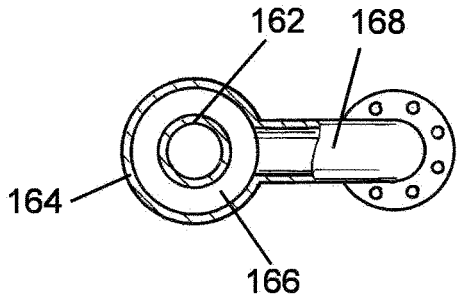
FIG. 12 is a view taken along the lines 12-12 of FIG. 11.
Figure 11:
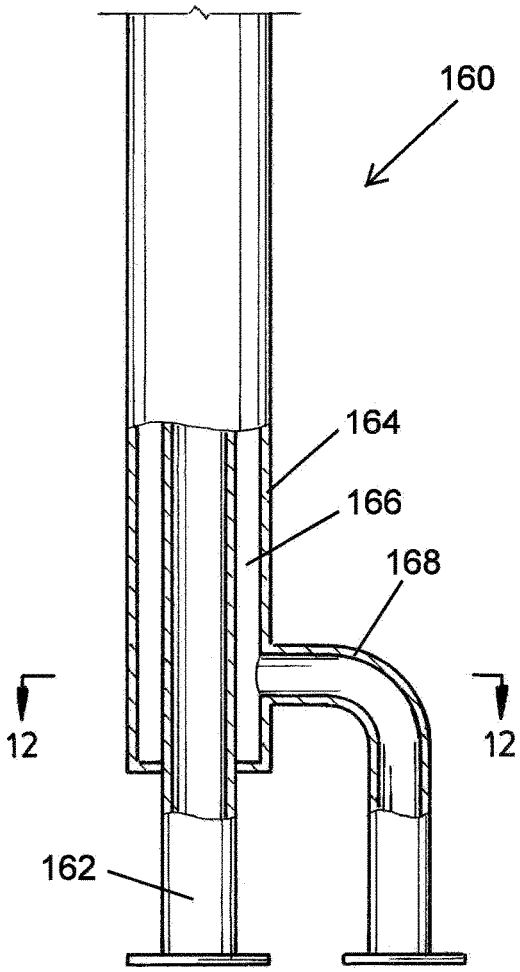
FIG. 11 is an elevational view of another embodiment of the flare gas assembly of the present invention.

Turning now to FIGS. 11 and 12, another embodiment of the present invention depicted generally as 160 is shown. In the embodiments shown in FIGS. 11 and 12, there is an air pipe or conduit 162 connected as described above to a blower or other source of air. In surrounding relationship to air pipe 162 is an outer pipe 164, an annulus 166 being formed between pipes 162 and 164. Annulus 166 receives flare gas from a pipe 168 connected to outer pipe 164. It will be appreciated that with regard to the upper ends of pipes 162 and 164, the elevation of upper end of pipe 162 is below that of outer pipe 164, as described above with respect to the other embodiments. In other words, the elevation of the air pipe or conduit 162 will be below the elevation of the outer pipe 164. Indeed, this is true of all the embodiments of the present invention in that the upper end of the air pipe is always below the upper end of the outermost pipe in order that a mixing chamber be formed above the upper open end of the air pipe and the upper end of the outermost pipe, it being understood that any intermediate pipe as shown in some of the embodiments will have an uppermost end which can be coterminous with the air pipe but which in any event will be below the upper open end of the outermost pipe. The embodiment of FIGS. 11 and 12 can be used either with high pressure or low pressure flare gas.

Figure 14:
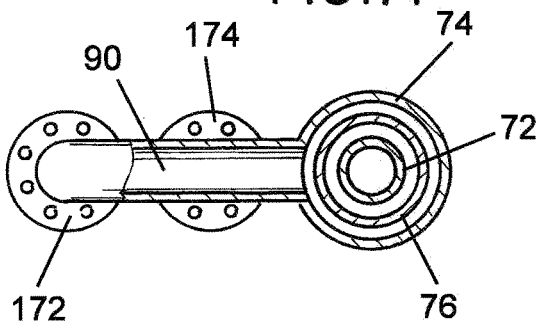
FIG. 14 is a cross-sectional view taken along the lines 14-14 of FIG. 13.
Figure 13:
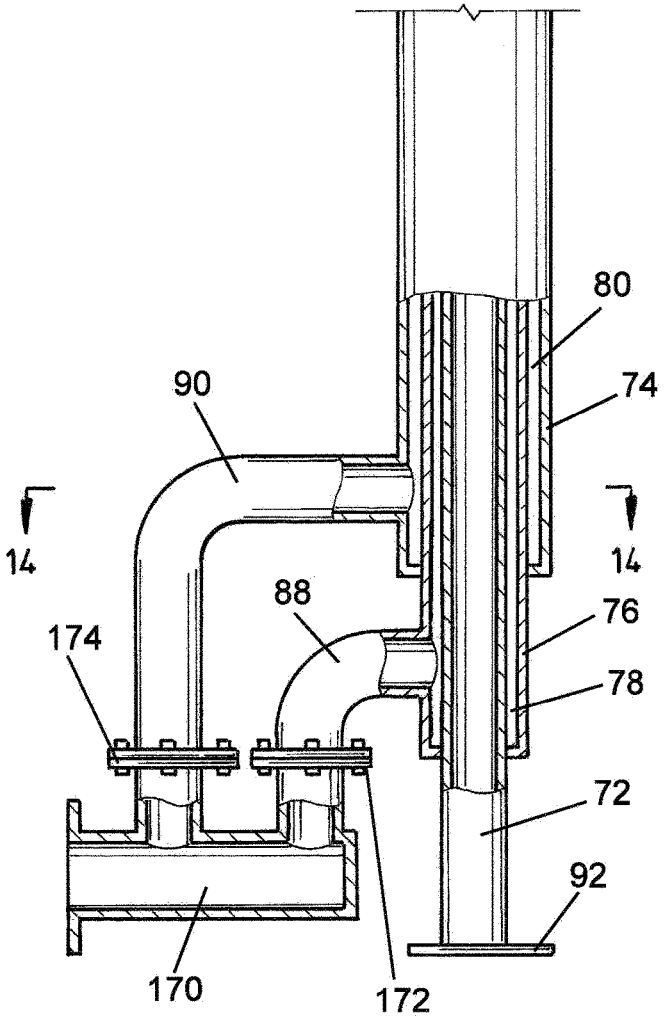
FIG. 13 is an elevational view, partly in section of another embodiment of the flare gas assembly of the present invention.
Figure 15:
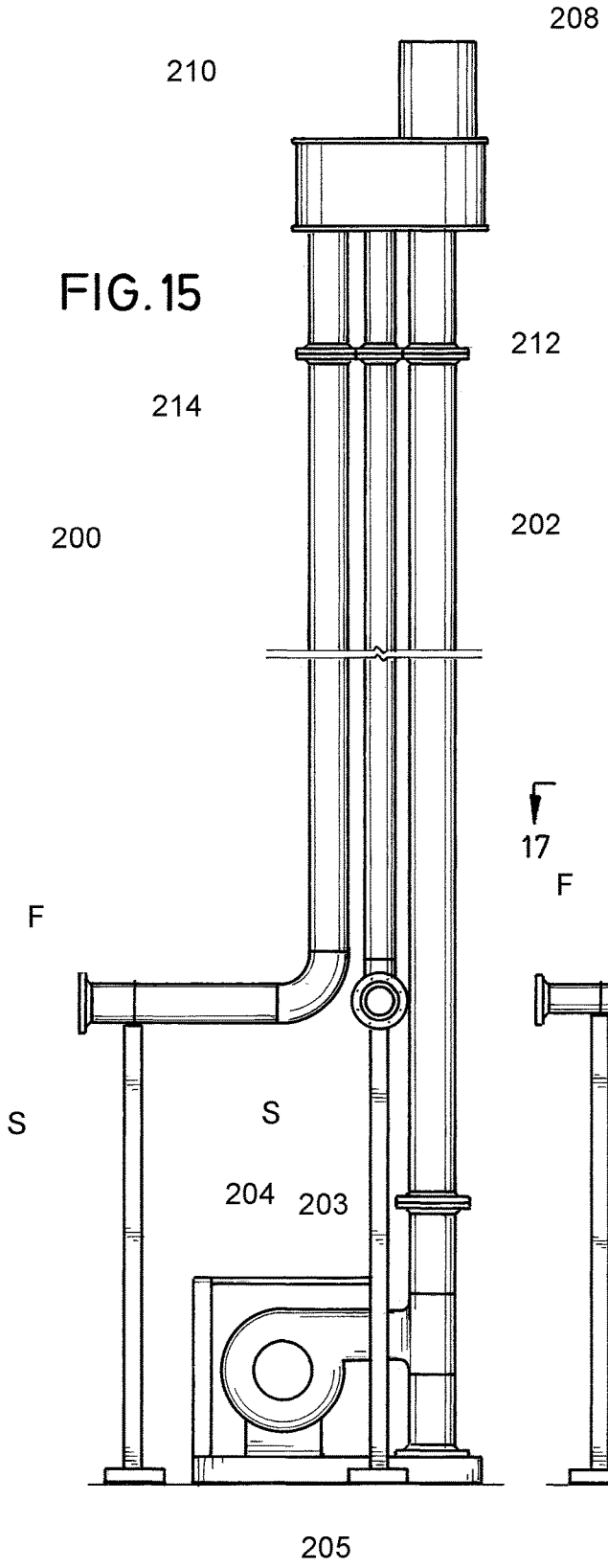
FIG. 15 is a side, elevational view of one embodiment of the flare gas assembly of the present invention.
Figure 16:
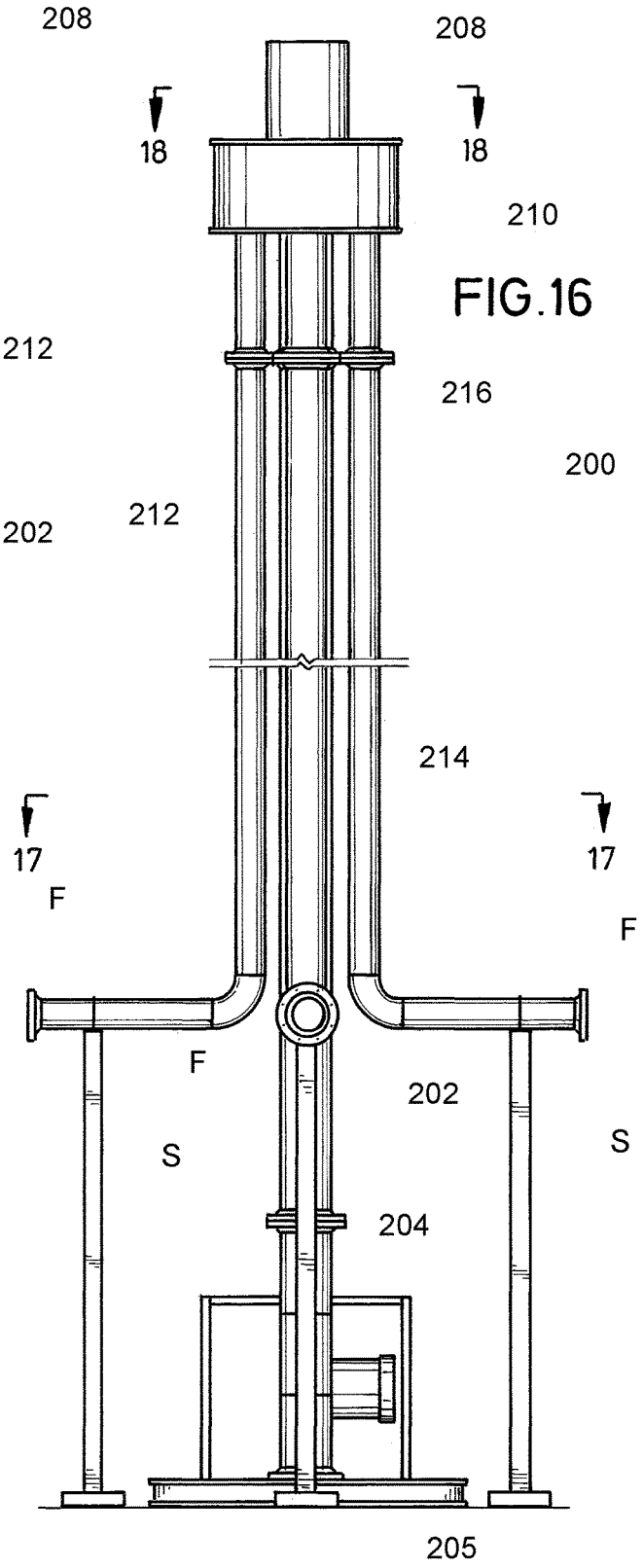
FIG. 16 is a front, elevational view of the embodiment shown in FIG. 15.
Figure 17:
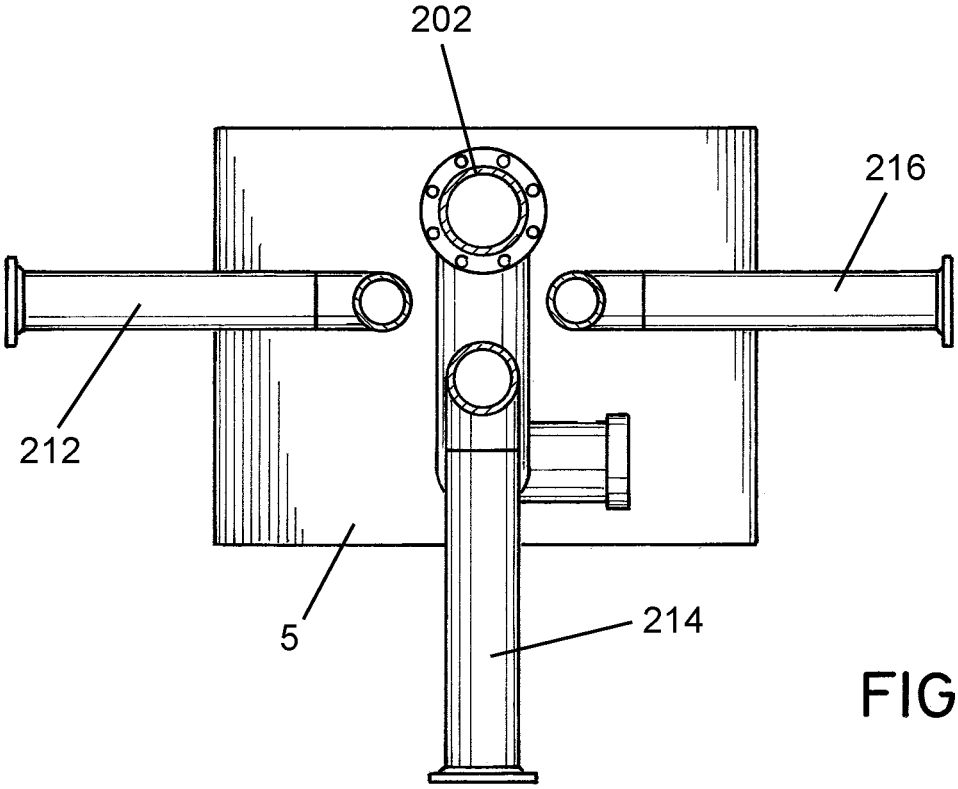
FIG. 17 is a view taken along the lines 17-17 of FIG. 16.

Turning now to FIGS. 13 and 14, there is shown a modification of the embodiment depicted in FIG. 5, In the embodiment shown in FIG. 5, the two flare gases, e.g., low pressure and high pressure flare gases, are introduced via pipes 88 and 90, respectively, each of the low and high pressure flare gases in pipes 88 and 90, coming from different sources. In the embodiment shown in FIGS. 13 and 14, the pipes 88 and 90 are connected to a common pipe 170 via typical flange connections 172 and 174, respectively. The embodiment depicted in FIGS. 13 and 14 is especially useful in cases where the tank batteries have a large volume of low pressure gas which needs to be vented. In the case of large volumes of high pressure gas, the plumbing arrangement shown with respect to the embodiment of FIGS. 13 and 14 is of little or no consequence because pressure drop issues do not come into play.

Referring now to FIGS. 15-20 there is shown another embodiment of the present invention capable of Gas Plant Gases, i.e., low pressure gas from tank batteries, high pressure gas from separators and intermediate pressure gas from VRTs and/or pressurized oil lines.

Referring to FIGS. 15-20, there is an air stack or pipe 202 connected by piping 203 to a forced air blower 204 resting on a pad 205. The air stack 202 which can be from about 20 to about 100 ft. in length, is connected to a plenum assembly shown generally as 210 and described more fully hereafter. A flare pipe assembly shown generally as 208 is connected to plenum assembly 210, flare pipe assembly 208 being adjacent a typical igniter (not shown).

Figure 19:
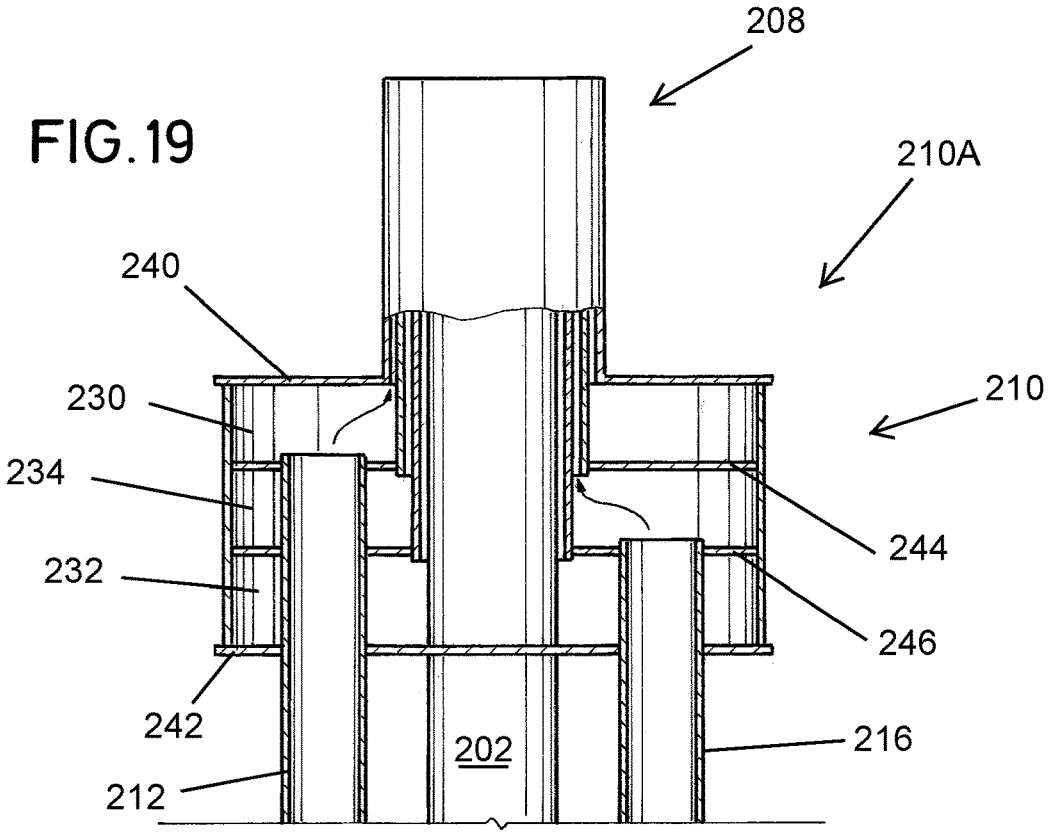
FIG. 19 is a view taken along the lines 19-19 of FIG. 18.
Figure 20:
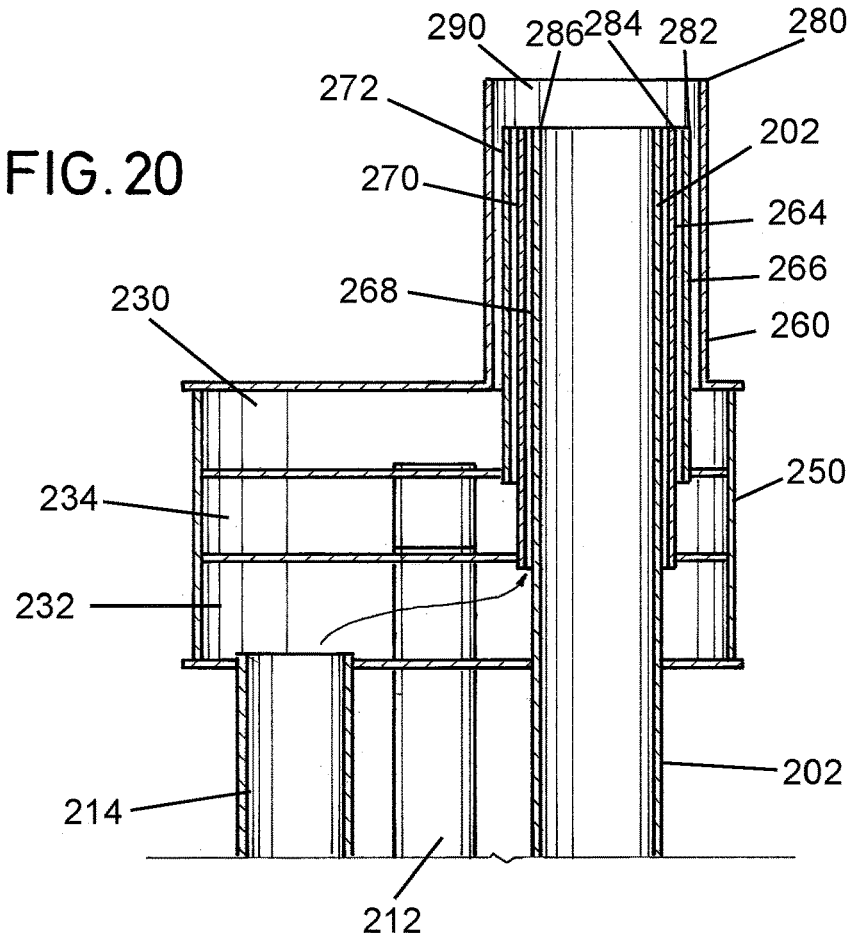
FIG. 20 is a view taken along the lines 20-20 of FIG. 18.

With reference to FIGS. 19 and 20, a high pressure flare gas conduit 212, a low pressure flare gas conduit 214, and an intermediate pressure flare gas conduit 216, are connected to plenum assembly 210. Each of the flare gas conduits 212, 214, and 216, have pipe flanges F to permit connection to suitable piping, and are supported by support stanchions S. Plenum assembly 210 comprises a generally cylindrical housing shown generally as 210A in which is formed a high pressure flare gas plenum 230, a low pressure flare gas plenum 232 and an intermediate pressure flare gas plenum 234.

Figure 18:
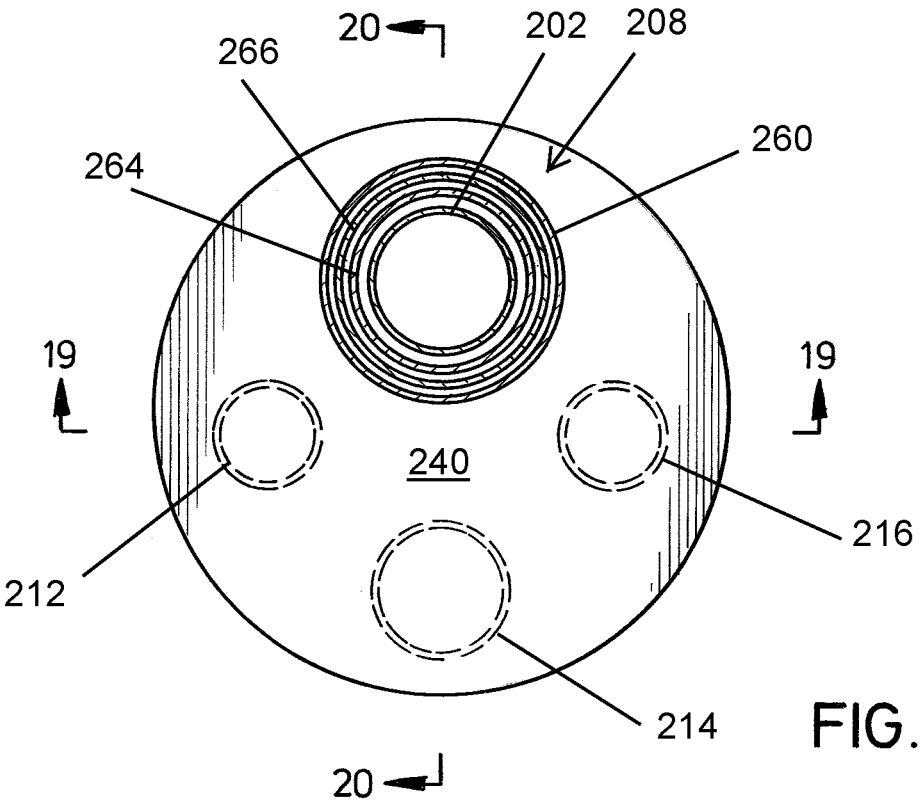
FIG. 18 is a view taken along the lines 18-18 of FIG. 16.

Housing 210A as shown in FIG. 18, is generally circular when viewed in top plan view Housing 210A comprises a top wall 240, a bottom wall 242, a first intermediate partition 244, and a second intermediate partition 246, all of which are connected to a peripheral wall 250 to form generally cylindrical housing 210A. As best seen in FIGS. 19 and 20, a first plenum 230 is formed by top wall 240, first intermediate partition 244, and a portion of peripheral wall 250, a second plenum 234 is formed by first and second intermediate partitions 244 and 246, respectively, and a portion of peripheral wall 250, and a third plenum 232 is formed by second intermediate partition 246, bottom wall 242, and a portion of wall 250. Again, as seen in FIGS. 19 and 20, flare gas conduit 212 is connected to first intermediate partition 244, and opens into plenum 230, flare gas conduit 214 is connected to bottom wall 242 and opens into plenum 232, while flare gas conduit 216 is connected to second intermediate partition 246 and opens into plenum 234.

While as described above, plenum housing 210A is generally cylindrical, it will be understood that it can take many shapes, e.g., rectangular, octagonal, etc.

Again, as can be seen with reference to FIGS. 18-20, flare pipe assembly 208 comprises an outermost cylindrical pipe 260, innermost cylindrical pipe 202 and a first intermediate cylindrical pipe 264 surrounding innermost cylindrical pipe 202, and a second intermediate cylindrical pipe 266 surrounding first intermediate pipe 264. Pipes 202 and 264 cooperate to form a first annular flow path 268, pipes 264 and 266 cooperate to form a second annular flow path 270 and pipe, and pipes 266 and 260 cooperate to form a third annular flow path 272. As can be seen, the upper, terminal end of outermost pipe 260 extends above the upper terminal ends 282, 284, and 286 of pipes 266, 264, and 202, respectively, thereby forming an open mixing chamber 290 above the upper terminal ends 282, 284, and 286, the chamber 290 being surrounded by an upper wall section 280 of pipe 260. Generally speaking, and preferably, in all the embodiments of the present invention, the distance between the upper terminal ends of the outermost pipe will be from about 2 to about 8 inches above the highest of the radially inner pipes, e.g., pipes 202, 264, and 266. In a preferred case, the upper terminal ends 282, 284, and 286 are coterminous.

In operation, air is forced upwardly through pipe 202 by means of blower 204 and exits into mixing chamber 290. By way of example, high pressure gas from pipe 212 flows into plenum 230 and exits plenum 230 through outer annular flow path 272 into mixing chamber 290. Low pressure flare gas flows from pipe 214 into low pressure plenum 232 and exits plenum 232 through annular flow path 268 into mixing chamber 290. Intermediate pressure flare gas flows from pipe 216 into plenum 234 and exits plenum 234 through annular flow path 270 into mixing chamber 290. It can thus be seen that high pressure flare gas, intermediate pressure flare gas, low pressure flare gas, and air enter mixing chamber 290 and mix, the mixture being ignited by an igniter (not shown).

While as shown in the embodiment of the invention depicted in FIGS. 15-20, the sources of flare gases are introduced into the bottoms of the respective plenums, it will be understood that the invention is not so limited. For example, the flare gas pipes could be connected to the peripheral wall 250 of plenum housing 210A such that the gases were introduced directly into the respective plenums.

A feature of the flare gas assemblies of the present invention is that the blowers can be operated at a single speed, e.g., a constant flow rate of from about 1,000 to about 10,000 CFM, and will effectively and efficiently combine with the flare gas(es) in the mixing chamber resulting in an almost ideal smokeless flare. This occurs regardless of whether the respective flare gases are being vented individually or simultaneously, and is independent of their relative flow rates and pressures.

While the invention has been described above in the embodiment of FIGS. 15-20 primarily with respect to the flaring of Gas Plant Gases of varying pressure, it is not so limited. For example, the flare gas assembly could be used for venting three sources of low pressure flare gas, three sources of intermediate pressure flare gas, or three sources of high pressure flare gas. In the case where there is a large volume of low pressure flare gas from tank batteries, or similar sources of low pressure flare gas, a single input of low pressure flare gas could be split into three flow paths up pipes 212, 214, and 216. Thus, while the description of the embodiment of FIGS. 15-20, specific reference is made to a high pressure flare gas, an intermediate pressure flare gas, and a low pressure flare gas, it is to be understood that such designations are by example only and that the respective flare gas pipes 212, 214, and 216 can be interchangeably used for low pressure, intermediate pressure, and high pressure flare gas.

A distinct feature of the flare gas assembly of the present invention is that forced combustion air is routed up a center pipe providing a central air column while the flare gas(es) is/are introduced into a 360° annular gas column(s) in surrounding relationship to the combustion air column. This configuration coupled with the mixing chamber formed at the top of the flare stack allows the flare gas to be subject to forced combustion air from the center air column and passive ambient air outside the gas air flare column. Accordingly, this unique construction means there is always a rich column of gas at the flare tip that can be easily ignited regardless of whether the gases being flared are high pressure, intermediate pressure, low pressure, or a mixture thereof.

Because the blower stays at a fixed, constant speed at all times and at all flare gas flow rates, the modulation of air flow using VFD systems is eliminated. In essence, the system of the present invention eliminates the need for flow meters, VFDs, computer interfaces, and other complicated, expensive equipment, and still achieves complete combustion of the flare gases. In a preferred embodiment, the blowers of the present invention are also simple in that they are direct drive systems. Thus, the motor output shaft is directly coupled to the impeller/fan, meaning that the speed of the motor determines the speed of the impeller/fan. For example, a typical blower for use in the flare gas assembly of the present invention can employ a motor rotating at 1700 RPMs, meaning that the impeller/fan of the blower is also operating at 1700 RPMs Preferred blowers for use in the present invention are centrifugal blowers which, as well known to those skilled in the art, are constant displacement or constant volume devices, meaning that at a constant rotational speed, the impeller moves a relatively constant volume of air rather than a constant mass. Accordingly, the air velocity in the system is fixed even though the mass flow rate through the fan may not be.

It is one of the features of the present invention that the system can consist essentially of a flare gas assembly as described above and a blower system comprised of a motor directly coupled to the impeller/fan blade of a centrifugal blower, whereby the speed in RPMs of the impeller is the same as the speed of the motor driving the impeller and is fixed during a flaring cycle. Depending upon the size of the flare, the volume of gas being handled, etc., speeds of 1700 to 3400 RPMs are generally suitable.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A flare gas assembly comprising:

an air pipe having an upper open end;

a first conduit in surrounding relationship to said air pipe and having a first conduit upper end, a first annulus being formed between said air pipe and said first conduit, said first annulus being connected to a source of a first flare gas;

a second conduit in surrounding relationship to said first conduit and having a second conduit upper end, a second annulus being formed between said first and second conduits, said second annulus being connected to a source of a second flare gas;

a third conduit in surrounding relationship to said second conduit and having a third conduit upper end, a third annulus being formed between said second and third conduits, said third annulus being connected to a source of a third flare gas, said third conduit upper end extending above said upper ends of said air pipe, said first conduit and said second conduit; and an air source connected to said air pipe to provide air to said air pipe at a desired flow rate.

2. The flare gas assembly of claim 1, wherein the distance between the closest of said upper end of said air pipe, said first conduit open end or said second conduit open end, to said third conduit open end is from about 2 to about 8 inches.

3. The flare gas assembly of claim 1, wherein said air pipe upper open end, said first conduit upper end, and said second conduit upper end are coterminous.

4. The flare gas assembly of claim 3, wherein the distance between said air pipe upper open end and said first conduit upper end is from about 2 to about 8 inches.

5. The flare gas assembly of claim 1, wherein said first annulus is connected to a source of said first flare gas by a first gas pipe.

6. The flare gas assembly of claim 1, wherein said second annulus is connected to a source of said second flare gas by a second gas pipe.

7. The flare gas assembly of claim 1, wherein said third annulus is connected to a source of said third flare gas by a third gas pipe.

8. A flare gas assembly for flaring first, second, and third flare gases comprising:

an air pipe having an upper open end;

a plenum housing in surrounding relationship to said air pipe, said plenum housing forming a first flare gas chamber, a second flare gas chamber, and a third flare gas chamber;

a first flare gas inlet into said first flare gas chamber;

a second flare gas inlet into said second flare gas chamber;

a third flare gas inlet into said third flare gas chamber;

a first conduit in surrounding relationship to said air pipe forming a first annulus having a first upper end;

a second conduit in surrounding relationship to said first conduit forming a second annulus having a second upper end;

a third conduit in surrounding relationship to said second conduit forming a third annulus having an upper wall section terminating in a third upper end;

said first annulus being in open communication with said first flare gas chamber;

said second annulus being in open communication with said second flare gas chamber;

said third annulus being in open communication with said third flare gas chamber;

said third upper end extending above said air pipe upper end, said first upper end, and said second upper end, and a mixing chamber being formed above said air pipe upper open end, said first upper end, said second upper end, and circumferentially bounded by said upper wall section.

9. The flare gas assembly of claim 8, wherein said plenum housing is circular when viewed in top plan view.

10. The flare gas assembly of claim 8, wherein said plenum housing comprises an upper wall, a bottom wall, first and second intermediate partitions between said upper and bottom walls, and a peripheral wall interconnecting said upper and bottom walls.

11. The flare gas assembly of claim 10, wherein said first flare gas chamber is formed between said upper wall and said first intermediate partition, said second flare gas chamber is formed between said first intermediate partition and said second intermediate partition, and said third flare gas chamber is formed between said second intermediate partition and said bottom wall.

12. The flare gas assembly of claim 8, wherein the distance between the closest of said upper open end of said air pipe, and said first upper end or said second upper end, to said third upper end is from about 2 to about 8 inches.

13. The flare gas assembly of claim 8, wherein said first gas inlet comprises a first pipe, and said second flare gas assembly comprises a second pipe, and said third flare gas inlet comprises a third pipe.

14. The flare gas assembly of claim 8, comprising a single blower connected to said air pipe, said blower being operated at a constant speed to provide a constant flow rate of air to said air pipe.

15. A method of operating a flare gas assembly, wherein the assembly comprises an air pipe having an upper open end, a first conduit in surrounding relationship to said air pipe and having a first conduit upper end, a first annulus being formed between said air pipe and said first conduit, a second conduit with a second conduit upper end in surrounding relationship to said first conduit, a second annulus being formed between said first and second conduits, and a third conduit in surrounding relationship to said second conduit, a third annulus being formed between said second and third conduits, the upper end of said third conduit extending above said upper open ends of said air pipe, said first conduit and said second conduit to form a mixing chamber, said method comprising:

introducing a first flare gas into said first annulus;

introducing a second flare gas into said second annulus;

introducing a third flare gas into said third annulus;

introducing combustion air into said air pipe at a constant flow rate;

mixing said combustion air with said first, second, and third flare gases in said mixing chamber; and combusting said mixed combustion air and flare gases.

16. The method of claim 15, wherein said upper open ends of said air pipe, said first conduit upper end, and said second conduit open end are coterminous and below said third conduit upper end.

17. The method of claim 15, wherein said flare gas assembly comprises at least one blower connected to said air pipe, said blower being operated at a constant speed to provide a constant flow rate of combustion air to said air pipe.

18. A flare gas assembly comprising:

an air pipe having an upper open end;

a first conduit in surrounding relationship to said air pipe and having a first conduit upper end, a first annulus being formed between said air pipe and said first conduit, said first annulus being connected to a source of a first flare gas;

a second conduit in surrounding relationship to said first conduit and having a second conduit upper end, a second annulus being formed between said first and second conduits, said second annulus being connected to a source of a second flare gas;

a third conduit in surrounding relationship to said second conduit and having a third conduit upper end, a third annulus being formed between said second and third conduits, said third annulus being connected to a source of a third flare gas; and an air source connected to said air pipe to provide air to said air pipe at a desired flow rate.

19. A flare gas assembly for flaring first, second, and third flare gases, comprising:

an air pipe having an upper open end;

a plenum housing in surrounding relationship to said air pipe, said plenum housing forming a first flare gas chamber, a second flare gas chamber, and a third flare gas chamber;

a first flare gas inlet into said first flare gas chamber;

a second flare gas inlet into said second flare gas chamber;

a third flare gas inlet into said third flare gas chamber;

a first conduit in surrounding relationship to said air pipe forming a first annulus having a first upper end;

a second conduit in surrounding relationship to said first conduit forming a second annulus having a second upper end;

a third conduit in surrounding relationship to said second conduit forming a third annulus having an upper wall section terminating in a third upper end;

said first annulus being in open communication with said first flare gas chamber;

said second annulus being in open communication with said second flare gas chamber; and said third annulus being in open communication with said third flare gas chamber.

20. A method of operating a flare gas assembly, wherein the assembly comprises an air pipe having an upper open end, a first conduit in surrounding relationship to said air pipe and having a first conduit upper end, a first annulus being formed between said air pipe and said first conduit, a second conduit with a second conduit upper end in surrounding relationship to said first conduit, a second annulus being formed between said first and second conduits, and a third conduit in surrounding relationship to said second conduit, a third annulus being formed between said second and third conduits, said method comprising:

introducing a first flare gas into said first annulus;

introducing a second flare gas into said second annulus;

introducing a third flare gas into said third annulus;

introducing combustion air into said air pipe at a constant flow rate;

mixing said combustion air with said first, second, and third flare gases; and combusting said mixed combustion air and flare gases.

* * * * *